US005161555A

United States Patent [19]

Cansler et al.

[11] Patent Number: 5,161,555

[45] Date of Patent: Nov. 10, 1992

[54] COSMETIC BRUSH

[75] Inventors: Ronald B. Cansler, Davidsonville; John Armiger, Ellicott City, both of Md.

[73] Assignee: Ketema, Odenton, Md.

[21] Appl. No.: 735,566

[22] Filed: Jul. 25, 1991

[51] Int. Cl.[5] ..... A45D 40/26

[52] U.S. Cl. ..... 132/218; 132/320; 15/206; 15/207.2

[58] Field of Search ..... 132/216, 218, 313, 317, 132/320; 15/159 A, 181, 206

[56] References Cited

U.S. PATENT DOCUMENTS

| | | | |
|---|---|---|---|
| 1,337,819 | 4/1920 | Braun | 15/206 |
| 2,511,004 | 6/1950 | Peterson et al. | 15/159 A |
| 2,790,986 | 5/1957 | Schwartz et al. | 15/159 A |
| 4,598,723 | 7/1986 | Cole | 132/218 |
| 4,617,948 | 10/1986 | Gueret | 132/218 |
| 4,632,136 | 12/1986 | Kingsford | 132/218 |
| 4,733,425 | 3/1988 | Hartel et al. | 132/218 |
| 4,861,179 | 8/1989 | Schrepf et al. | 132/218 |
| 4,927,281 | 5/1990 | Gueret | 132/218 |

FOREIGN PATENT DOCUMENTS

| | | | |
|---|---|---|---|
| 2170996 | 8/1986 | United Kingdom | 132/218 |

*Primary Examiner*—Gene Mancene
*Assistant Examiner*—Frank A. LaViola
*Attorney, Agent, or Firm*—Browdy and Neimark

[57] ABSTRACT

An improved mascara brush is formed according to the standard twisted wire method, but utilizing heavily waved bristles instead of straight bristles. During the brush forming operation, the bristles orient so that the ends of the bristles are generally evenly distributed along the cylinder outline of the brush, i.e. the usual spiral groove is eliminated. The improved mascara brush has improved properties in that it picks up more mascara and more evenly distributes the mascara on the eyelash.

20 Claims, 1 Drawing Sheet

COSMETIC BRUSH

FIELD OF INVENTION

The present invention relates to improvements in cosmetic brushes, and more particularly to improved twisted wire mascara brushes.

BACKGROUND OF THE INVENTION

Twisted wire mascara brushes have been known for many years. Such brushes 10 as shown in FIG. 1 comprise a plurality of straight bristles 12 extending generally outwardly from an axial core of twisted wires 14 and forming a spiral pattern along the length of the wires 14, the bristles 12 being anchored at their midpoints 16 by being trapped between the twisted wires 14. As seen in FIG. 1, these prior cosmetic brushes 10, while defining a generally cylindrical outline, have a large spiral gap 18 lying adjacent the spiral pattern defined by the trapped bristles 12.

Such spiral pattern is a natural consequence of the method of making the brush 10 by trapping and pinching the straight bristles 12 between the twisted wires 16. This method is simple, effective and long established, and consequently mascara brushes are, insofar as is known, always made in this configuration even though the spiral pattern does not provide the best mascara brush from a functional standpoint. The patent literature almost invariably shows mascara brushes having this spiral pattern (e.g. the U.S. patents to Cassai et al U.S. Pat. No. 4,428,388; Mantelet U.S. Pat. No. 4,056,111; U.S. Pat. No. Kingsford 4,332,494 and Masters et al U.S. Pat. No. 3,214,782; Cassai U.S. Pat. No. Des. 282,107 and Hahn U.S. Pat. No. Des. 122,109), an exception being the ancient Mason U.S. Pat. No. Des. 27,010. The twisted wire method includes a second step which is known as "rifling", an operation in which the bristle ends are trimmed or chiseled to give the brush its overall exterior configuration. This rifling operation does not modify the aforementioned spiral pattern.

The spiral pattern mascara brush has the significant functional disadvantage of non-uniformity. It does not pick up cosmetic, e.g. mascara, uniformly and it does not deposit the mascara uniformly. In spite of these functional disadvantages, the spiral pattern twisted wire mascara brush has remained the industry standard because of its ease and simplicity of manufacture.

The aforementioned problems have been largely obviated or at least reduced by the development of the mascara brush disclosed in the Hartel et al U.S. Pat. No. 4,733,425 which relies on bristles having a cross-sectional configuration, preferably cylindrical hollow, which bristles at least partially collapse or crimp when they are squeezed by the twisted wires so that the ends of the bristles flare outwardly to provide a more uniform pattern. However, while the Hartel et al mascara brush largely solves the appearance problem of the prior art, it creates new problems. Thus, because the bristles used in the Hartel et al mascara brush are preferably hollow, or at least have an irregular cross-section having flanges or ribs, the ends of the bristles exhibit significant capillary attraction for the liquid mascara and thus have a tendency to retain undeposited mascara after use. This in turn provides potential bacterial breeding sites. Another problem is that some of the bristles become weakened where they are grasped by the twisted wires, and this in turn provides a greater tendency for the bristles to break off and irritate the eye.

SUMMARY OF THE INVENTION

It is, accordingly, an object of the present invention to overcome deficiencies in the prior art, such as indicated above.

It is another object of the invention to provide an improved, more uniform twisted wire mascara brush which does not suffer from weakness or provide bacterial breeding sites.

It is a further object of the invention to maintain the popular twisted wire construction while providing a functionally superior mascara brush.

It is yet another object of the invention to provide a uniform mascara brush having a twisted wire core with the bristle ends generally evenly distributed along the cylinder outline of the brush.

It is yet a further object of the present invention to provide an improved mascara brush formed of smooth-surfaced bristles provided with an axially extending waved configuration.

These and other objects and the nature and advantages of the present invention will be more apparent from the following detailed description of a specific embodiment thereof, taken in conjunction with the drawing, wherein:

DETAILED DESCRIPTION OF EMBODIMENTS

Figure 1:
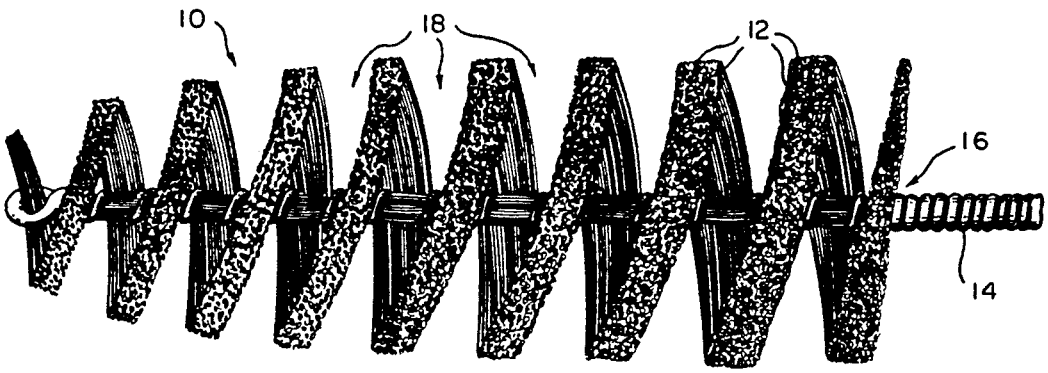
FIG. 1 PRIOR ART
FIG. 1 is an enlarged longitudinal side view of the typical prior art construction.
Figure 2:
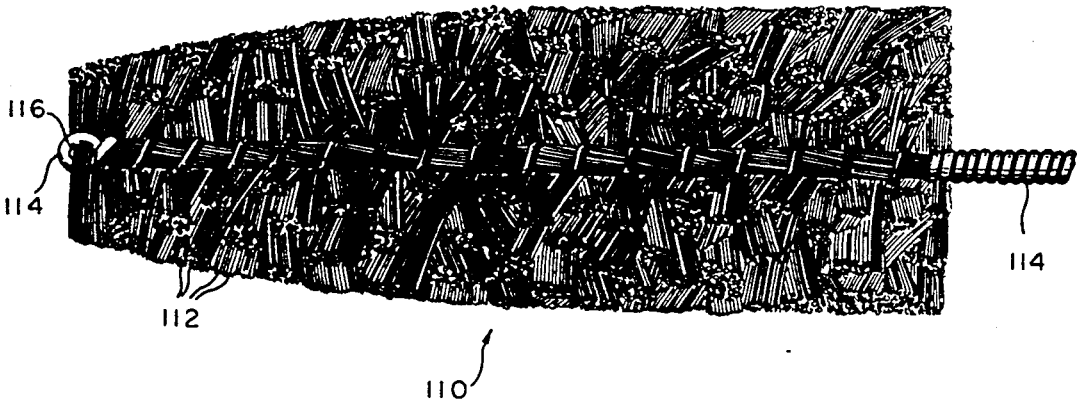
FIG. 2 is a similar view of a cosmetic brush according to the present invention.
Figure 3:
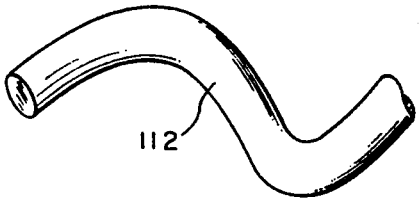
FIG. 3 is a greatly enlarged partial perspective view of a waved bristle for use in the construction of the brush of the present invention.

A mascara brush 110 according to the present invention is shown in FIG. 2, and comprises a plurality of heavily waved bristles 112 extending generally radially outwardly from an axial core of twisted wires 114, the bristles 112 being anchored at their midpoints 116 by being trapped between the twisted wires 114. As with the prior art brush 10, the brush 110 has or defines a generally cylindrical outline, the precise configuration of which is determined by the conventional rifling process. In this regard, it will be understood that the term "generally cylindrical" is intended to cover other generally cylindrical configurations such as tapered and frustoconical configurations as well as circular cylindrical configurations.

The heavily waved bristles 112 used in the mascara brush 110 of the present invention constitute a critical feature of the present invention. By "heavily waved" what is meant is that the bristles have been deeply precrimped with an exceptionally heavy amplitude. It is essential that the amplitude of the bristles 112 be high, i.e. at least 10 mils ($26\times10^{-3}$ cm), desirably 15–25 mils ($38\text{–}64\times10^{-3}$ cm), and preferably 18–21 mils ($46\text{–}53\times10^{-3}$ cm). The wave imparted to the bristles may be either uniform or non-uniform, but it is desirable that the frequency be as high as possible, i.e. at least about 4crimps per inch (10.2 crimps per cm), preferably 5–6 crimps per inch (12.8–15.4 crimps per cm).

The heavily waved configuration of the bristles 112 insure that the bristles do not extend outwardly from the twisted wires 114 all in the precisely same direction which occurs in the prior art straight bristles 12 and thus results in the gaps 18 of the prior art mascara brush 10. Instead, the bristles 112 extend outwardly in a random pattern from the twisted wires 114 and result in a full generally uniform distribution of the bristle ends to provide the appearance shown in FIG. 2. In other words, precisely where on the curvature of the wave the bristle 112 is grasped will determine the precise direction in which it projects radially outwardly, and as a result the bristles 112 flare outwardly in a more or less random manner which thus results in uniform bristle tip distribution at the bristles face of the mascara brush 110.

The heavily waved bristles 112 are desirably of 2–7 mils ($5\times10^{-3}$ to $17\times10^{-3}$ cm) diameter, preferably 3–5 mils ($7.7\times10^{-3}$ to $12.8\times10^{-3}$ cm) and desirably formed of nylon 6/12 which has good properties for a mascara brush including good flexure properties and low moisture pickup. It will be understood, however, that other thermoplastics can be used, if desired, including other nylons, polyesters such as PET and PBT, polyolefins such as PE and PP, and blends thereof. The mascara brush 110 is desirably provided in standard sizes, such as 1 inch long and 0.25 inch diameter.

While the heavily waved bristles 112 are preferably circular cylindrical in cross-section, other configurations can be provided, e.g. oval, ellipsoidal, etc. However, configurations with radially extending ribs or the like should be avoided because of creases or depressions which can trap mascara and provide bacteria-breeding sites.

It has further been discovered according to the present invention that an improved brush tip distribution occurs if the metal wires 114 are twisted to a greater extent than is conventional in the art. Thus, it has been found that to obtain the best results the wires 114 should comprise at least 18 twists per inch rather than the usual industry standard of a maximum of about 14 or 15 twists per inch. In order to better achieve more twists per inch of the wire 114, a somewhat finer metallic wire is selected than is conventional, such wire having a diameter of 18–25 mils, preferably 23–24 mils, the lower value being somewhat dependent on the desired flexibility of the resultant mascara brush.

The brush 110 of the present invention has significantly improved properties compared to the standard mascara brush 10, yet is made in the same way thus avoiding any necessity for the brush manufacturer to change its equipment or techniques. The functional advantages lie largely in the ability of the brush 110 to pick up more mascara and to distribute it more evenly on the eyelash.

While the invention is described above in relation to certain specific embodiments, it will be understood that many variations are possible without departing from the invention. In some cases such variation and substitutions may require some experimentation, but such will only involve routine testing.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a twisted wire mascara brush defining a generally cylindrical outline comprising a plurality of non-hollow bristles extending generally radially outwardly from an axial core of twisted wires along the length of said wires, said bristles being anchored at their midpoints by being trapped between said twisted wires, the improvement wherein:

said non-hollow bristles are heavily waved with the ends thereof being generally evenly distributed along the cylindrical outline of said brush.

2. A mascara brush according to claim 1 wherein said heavily waved non-hollow bristles are of approximately 2–7 mil outside diameter.

3. A mascara brush according to claim 2, having dimensions of about 1 inch long and about ¼ inch in diameter.

4. A mascara brush according to claim 2 wherein said heavily waved bristles are of nylon.

5. A mascara brush according to claim 1 wherein said heavily waved bristles are of approximately 3–5 mil outside diameter.

6. A mascara brush according to claim 1 wherein said heavily waved bristles have a wave frequency of 4–10 crimps per inch.

7. A mascara brush according to claim 1 wherein said heavily waved bristles have a wave frequency of 5–6 crimps per inch.

8. A mascara brush according to claim 1 wherein said heavily waved bristles have an amplitude of at least $26\times10^{-3}$ cm.

9. A mascara brush according to claim 1 wherein said heavily waved bristles have an amplitude of $38\text{–}64\times10^{-3}$ cm.

10. A mascara brush according to claim 1 wherein said heavily waved bristles have an amplitude of $46\text{–}53\times10^{-3}$ cm.

11. A mascara brush according to claim 1 wherein said axial core of twisted wires comprises greater than 18 twists per inch.

12. A mascara brush according to claim 1, wherein said bristles are heavily waved along their entire lengths.

13. A cosmetic brush comprising a brush core and bristle portion having a bristle face of generally circular configuration, said brush core being formed by lengths of metallic wire helically twisted together, said bristle portion being formed by a plurality of bristles extending radially from said brush core, pairs of said bristles being formed by discreet synthetic plastic filaments which have a solid bristle core and are heavily waved and which are gripped medially of their outer ends by the twisted lengths of wire, the gripping of said heavily waved bristles causing said bristles to flare outwardly in various directions from said brush core whereby tip portions of said bristles are generally uniformly distributed throughout said bristle face.

14. A cosmetic brush according to claim 3, wherein said bristles are of approximately 2–7 mil outside diameter

15. A cosmetic brush according to claim 13, in the form of a mascara brush having dimensions of about 1 inch long and about ¼ inch in diameter.

16. A cosmetic brush according to claim 13, wherein said bristles are approximately 3–5 mil outside diameter.

17. A cosmetic brush according to claim 13, wherein said bristles have a wave amplitude of at least $26\times10^{-3}$ cm.

18. A cosmetic brush according to claim 13, wherein said bristles have a wave amplitude of $46\times10^{-3}$ to $64\times10^{-3}$ cm.

19. A cosmetic brush according to claim 13, wherein said twisted lengths of wire have at least 18 twist per inch.

20. A cosmetic brush according to claim 13, wherein said bristles are heavily waved along their entire lengths.

* * * * *